United States Patent [19]

Fisher et al.

[11] 4,336,045

[45] Jun. 22, 1982

[54] ACETYLENE REMOVAL IN ETHYLENE AND HYDROGEN SEPARATION AND RECOVERY PROCESS

[75] Inventors: Theodore F. Fisher; John B. Saunders, both of Tonawanda, N.Y.

[73] Assignee: Union Carbide Corporation, Danbury, Conn.

[21] Appl. No.: 278,725

[22] Filed: Jun. 29, 1981

[51] Int. Cl.[3] ..... F23J 3/02; F23J 3/06; F23J 3/08

[52] U.S. Cl. ..... 62/17; 62/20; 62/31; 62/39; 208/351

[58] Field of Search ..... 62/9, 11, 17, 19, 20, 62/23, 24, 32, 34, 38, 39, 29, 31, 25; 208/350, 351, 352, 353, 354, 361

[56] References Cited

U.S. PATENT DOCUMENTS

| | | | |
|---|---|---|---|
| 2,775,103 | 12/1956 | Koble et al. | 62/39 |
| 3,607,963 | 9/1971 | Dannel | 62/39 |
| 3,635,038 | 1/1971 | Nagel et al. | 62/17 |
| 3,729,944 | 5/1973 | Kelly et al. | 62/39 |

*Primary Examiner*—Frank Sever
*Attorney, Agent, or Firm*—Alvin H. Fritschler

[57] ABSTRACT

A selected paraffinic or olefinic liquid is used to scrub acetylene from a minor gas fraction of uncondensed gas from a hydrocarbon feed mixture containing ethylene, hydrogen, acetylene and methane. Hydrogen product gas is separated and recovered from said minor gas fraction. The major gas fraction is processed without said acetylene removal operation, but under elevated pressure conditions effectively avoiding acetylene solidification during the separation and recovery of an ethylene-enriched liquid.

16 Claims, 1 Drawing Figure

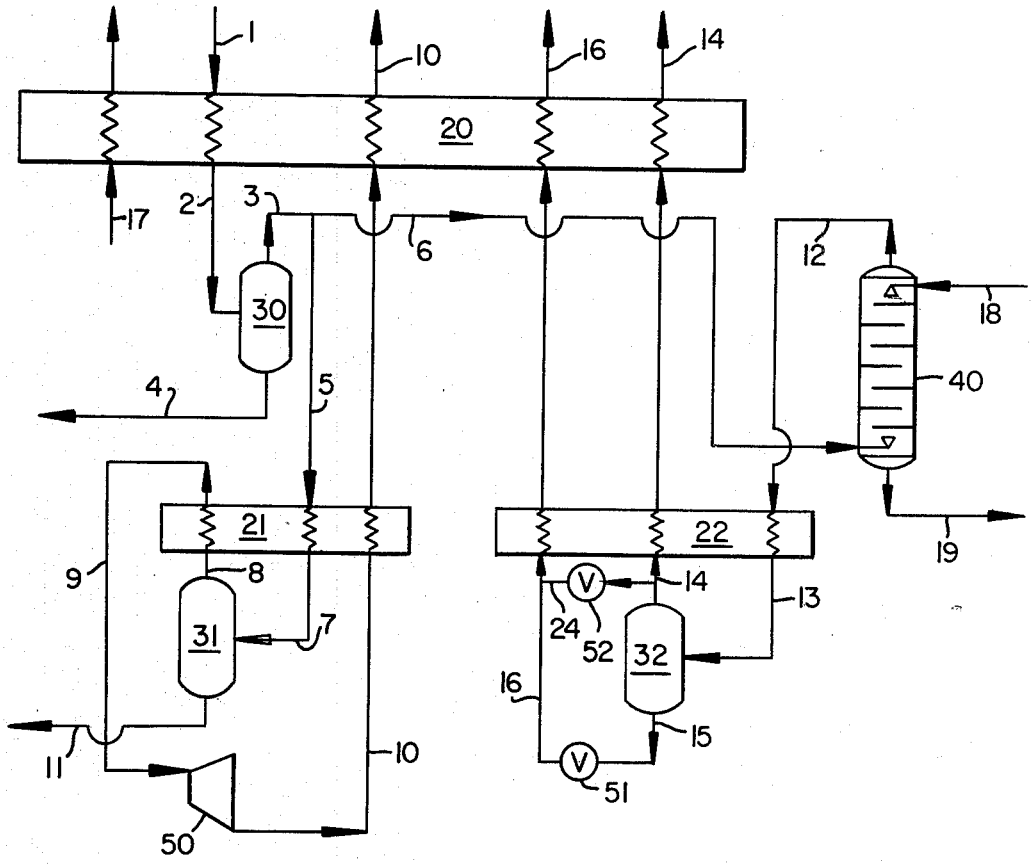
1
10
16
14
20
17
2
3
6
12
18
30
4
5
40
21
22
19
9
8
14
13
24
52
31
7
32
16
15
11
10
51
50

ACETYLENE REMOVAL IN ETHYLENE AND HYDROGEN SEPARATION AND RECOVERY PROCESS

BACKGROUND OF THE INVENTION

1. Field of the Invention

The invention relates to the separation and recovery of ethylene and hydrogen from hydrocarbon feed mixtures. More particularly, it relates to the avoiding of acetylene solidification during said separation and recovery operations.

2. Background of the Invention

The chemical processing industry has long recognized the significant problems that are created as a result of acetylene solidification in hydrocarbon separation systems, e.g., in an ethylene plant. Not only does such solidification create plugging problems in cold process piping and equipment, but the instability of solid acetylene creates a very hazardous and explosive environment within the system. Extreme care must be exercised, therefore, to avoid any potential for acetylene solidification in such hydrocarbon separation systems.

In many cases, ethylene plants and other hydrocarbon separation systems are designed to remove acetylene at the warm end of said systems. Typical operations for this purpose employ either catalytic hydrogenation of the acetylene content of hydrocarbon feed mixtures over a platinum or palladium catalyst, or a physical or chemical absorption of said acetylene, employing a variety of suitable solvents, e.g., methanol, acetone or dimethalformamide (DMF). Additional information concerning ethylene plants utilizing either of these acetylene removal techniques is available in numerous prior art references, such as the following U.S. Pat. Nos.: 2,818,920—Cobb; 2,915,881—Irvine; 3,095,293—Kuerston; 3,187,064—Wang et al and 4,167,402—Davis. In other cases, cracked gases may be produced under furnace cracking conditions such that the quantity of acetylene formed is low enough to permit its safe handling without the necessity for employing such processing techniques in the warm end of hydrocarbon separation systems. Depending upon the particular feedstock employed and the operating conditions prevailing in the cracking furnace, however, significant quantities of acetylene may nevertheless be present in the hydrocarbon gas stream delivered to the cold end of the hydrocarbon separation system even in such cases intended to minimize the acetylene content of said stream. In such instances, the processing of the hydrocarbon gas stream at the cold end of the separation system must be appropriately regulated to avoid the solidification of the acetylene content of said stream.

Recognizing the seriousness of the potential for acetylene solidification in the cold end of hydrocarbon separation systems, the art has proposed several alternative approaches for solving this problem. In one such approach, the ethylene concentration of the feed gas is monitored and regulated by the injection of pure ethylene therein, as needed, to insure that sufficient ethylene is present in any of the subsequently condensed liquid phases to serve as a solvent for any acetylene that might otherwise solidify during the processing of the hydrocarbon feed gas.

The problem of acetylene solidification was also recognized in the Danneil et al patent, U.S. Pat. No. 3,607,963 specifically with regard to a process designed to recover acetylene from a gas obtained from the cracking of petroleum or petroleum fractions by a flame burning beneath the surface thereof. In this process, the cracked gas is cooled by countercurrent heat exchange with warming streams recovered from the cracked gas. The gas stream is first cooled to a temperature above the solidification temperature of acetylene when in admixture with other condensible components of the cracked gas. This cooling results in the condensation of a liquid fraction that contains a large portion of the ethylene content of the cracked gas. The condensed liquid fraction is then separated from the uncondensed gas as a product stream. The total uncondensed gas stream is then freed from acetylene therein by washing such gas with a liquid consisting of ethane, ethylene or a mixture thereof. The gas mixture, essentially free of acetylene, is then further cooled to condense substantially all of the remaining fraction of ethylene in the thus-treated cracked gas feed. The condensed liquid is then removed as a product, which can be further treated to recover the ethylene content thereof. The uncondensed gas fraction is work expanded to low pressure to develop process refrigeration. By this process of Danneil et al, the potential for acetylene solidification during the work expansion step is said to be essentially eliminated.

The problem of acetylene solidification can also be avoided in the operation of many ethylene fractionation systems at high superatmospheric pressures, i.e., above about 370 psia (25 atmospheres). By operating at such high pressures, acetylene solidification can generally be avoided in the ethylene recovery section of the cold end of a hydrocarbon separation system. Thus, enough acetylene is generally removed with the condensed hydrocarbon liquid fractions at such high pressures, so that very little acetylene is left in the uncondensed gas fraction that is subsequently work expanded to low pressures to develop refrigeration for the process. Under such circumstances, the acetylene wash system disclosed in the Danneil et al patent is not generally needed to prepare the cracked gas for ethylene recovery in the cold end of the hydrocarbon separation system, unless the process is operated at relatively low superatmospheric pressures.

Such use of high superatmospheric pressures for ethylene recovery does not, however, remove acetylene solidification as a problem in hydrocarbon separation systems. To the contrary, the hydrogen recovery section of the cold end of a hydrocarbon recovery system can not be conveniently operated under appropriate conditions so as to avoid acetylene solidification although, as indicated above, it is possible to operate the ethylene recovery section so as to avoid such undesired acetylene solidification. In order to successfully produce a high purity hydrogen stream, essentially all of the less volatile components of the cooled cracked gas must be removed from the hydrogen component. This requires the use of extremely low temperatures, generally below about −150° C. (123° K.). Such low temperatures are provided by reboiling the separated liquid fraction at a low pressure, generally below about 60 psia (4 atmospheres), oftentimes with the admixture of a small amount of product hydrogen to further reduce the reboil temperature. Unless the amount of acetylene present in the separated liquid fraction is quite low, the acetylene will likely solidify when this liquid is subsequently throttled to the low pressure. Because of the low pressure and low temperatures involved in the hydrogen recovery section of the system, the threshold acetylene concentration that can be tolerated in the separated liquid is very low.

The separation and recovery of ethylene and hydrogen from hydrocarbon feed mixtures can thus be seen as an operation concerning which improvement would be desirable in the art. While the use of certain processing conditions as taught in the art may serve to reduce the problem of acetylene solidification, it will be seen from the above that the presence of acetylene in the various streams processed in the cold end of the separation system presents a genuine potential for serious processing difficulties in commercial practice. The alternative approaches of acetylene control or removal as discussed above, i.e., the injection of pure ethylene into the monitored feed gas to act as a solvent for the acetylene content of the feed gas or the Danneil et al process for washing the uncondensed gas to remove said acetylene therefrom, provide possible solutions that are not entirely satisfactory in practical commercial operations. The capital and operating costs associated with such approaches represent additional expenses solely for acetylene treatment, thus tending to reduce the practical feasibility of the overall separation process. The necessity for treating the hydrocarbon feed stream or the overall uncondensed gas fraction because of the potential for acetylene solidification problems, which differ in different sections of the cold end of the hydrocarbon recovery system, constitutes one aspect of the disadvantages associated with such prior art solutions to the problem of acetylene solidification in a hydrocarbon recovery system.

It is an object of the invention, therefore, to provide an improved process for avoiding the solidification of acetylene in hydrocarbon separation systems for ethylene and hydrogen separation and recovery.

It is another object of the invention to provide a process for ethylene and hydrogen recovery from hydrocarbon feed mixtures in which the amount of gas treated to avoid acetylene solidification is minimized.

It is a further object of the invention to provide a process for eliminating the potential for acetylene solidification in ethylene recovery plants, while minimizing the capital and operating costs associated with such acetylene treatment operations.

With these and other objects in mind, the invention is hereinafter described in detail, the novel features thereof being particularly pointed out in the appended claims.

SUMMARY OF THE INVENTION

A minor fraction of the uncondensed gas portion of a hydrocarbon feed mixture containing ethylene, hydrogen, acetylene and methane is scrubbed with a selected paraffinic or olefinic liquid to effectively remove the acetylene content thereof prior to further processing to separate and recover hydrogen product. The major fraction of said uncondensed gas is not so treated, however, said gas fraction being processed for ethylene separation and recovery under high pressure conditions such as to avoid acetylene solidification problems.

BRIEF DESCRIPTION OF THE DRAWINGS

The invention is hereinafter further described with reference to the accompanying single FIGURE drawing comprising a schematic flow diagram of an embodiment of the cold end of an ethylene recovery plant adapted for the practice of the invention.

DETAILED DESCRIPTION OF THE INVENTION

The objects of the invention are accomplished by the use of an effective acetylene scrubbing step, but only for the treatment of the minor gas fraction of a hydrocarbon feed mixture processed for the recovery of hydrogen product. The major gas fraction need not be so treated, but is processed for ethylene recovery under operating conditions that effectively avoid the problem of acetylene solidification.

The acetylene scrubbing step of the invention is carried out with an essentially acetylene-free paraffinic or olefinic liquid or liquid mixture selected from the group consisting of ethylene, ethane, propylene and propane. The generally available liquid for this scrubbing step is ethylene. The scrubbing of the minor gas fraction is carried out so that a substantial portion of the acetylene content of said gas fraction is removed therefrom. The resulting acetylene-depleted gas fraction can thereafter be cooled and further processed as described below without acetylene solidification problems.

As used herein, the term "essentially acetylene-free" with respect to the scrubbing liquid means that the scrubbing liquid contains no more then about 1,000 ppm of acetylene. Such liquid preferably is product grade material containing less than 1 ppm acetylene.

The major fraction of the uncondensed gas portion of the hydrocarbon feed mixture, which is not scrubbed for acetylene removal in the practice of the invention, comprises at least about 75% of the molar flow rate of said uncondensed gas portion. In particular embodiments, the major fraction may comprise at least about 85% or 90% of said molar flow rate of the uncondensed gas portion. Under such conditions, the quantity of gas scrubbed for acetylene removal can be minimized, thus minimizing the capital and operating costs associated with acetylene removal, without adverse effect on the desirable overall object of avoiding acetylene solidification in the cold end of the hydrocarbon separation system. Within such limits, the relative proportions of said major and minor gas fractions will vary in particular embodiments depending upon the quantity of product hydrogen desired.

Referring to the drawing, a hydrocarbon feed gas mixture containing at least ethylene, hydrogen, methane and a small amount of acetylene is passed, at a relatively high super-atmospheric pressure, from line 1 into heat exchanger 20. The feed gas is cooled therein to condense a first liquid fraction comprising at least $C_1$–$C_2$ constituents at a temperature that is sufficiently high to avoid acetylene solidification problems, e.g., between about 140° K. and about 185° K. The cooling of the feed gas is accomplished by heat exchange with outgoing streams in conduits 10,14 and 16, as hereinafter described. Additional refrigeration may also be supplied by a refrigeration system, as for example liquid ethylene as represented schematically by line 17. It will be appreciated by those skilled in the art that this initial cooling step can actually be carried out in two or more stages of condensation employing a series or parallel arrangement of heat exchange operations.

The partially condensed gas mixture exiting from heat exchanger 20 through line 2 is introduced into separator 30 wherein a first liquid fraction containing ethylene is separated from the hydrogen-containing, cooled uncondensed portion of the feed gas mixture. The first liquid fraction is withdrawn from separator 30 through line 4. This liquid fraction, which also contains a major portion of the acetylene content of the feed gas mixture, may comprise a feed stream for a demethanizer column, not shown, as part of the overall ethylene plant processing operation.

The cooled, uncondensed gas portion of the feed stream is withdrawn from separator 30 in line 3 and is divided into a first, major gas fraction and a second, minor gas fraction in the proportions indicated above. The first, major gas fraction is removed in line 5 for treatment to recover additional ethylene for recycle to said demethanizer column or for other use. The second, minor gas fraction, on the other hand, is removed in line 6 for treatment to recover product hydrogen. The invention will be appreciated as being useful particularly in practical commercial applications in which the desired quantity of product hydrogen is a minor fraction of the uncondensed gas recovered from separator 30, namely when the molar flow rate in line 6 is less than about 25%, and in many instances less than about 15%, of the molar flow rate of uncondensed gas in line 3.

The second, minor gas fraction in line 6 is delivered to the bottom of multistage gas-liquid contactor 40, wherein said gas is treated to remove a substantial portion, i.e., essentially all, or down to less than about 100 ppm, of the acetylene content thereof. For this purpose, the gas fraction is scrubbed in contactor 40 with a subcooled, essentially acetylene-free liquid as described above, e.g., 99.95% ethylene, which is introduced into the top of column 40 through line 18. Spent scrub liquid withdrawn from contactor 40 through line 19, containing essentially all of the acetylene in said second, minor gas fraction, may be recycled to an appropriate separation unit in the overall ethylene recovery plant, as will be appreciated by those skilled in the art.

Acetylene-depleted gas is recovered from contactor 40 in line 12 and is cooled in heat exchanger 22 to condense substantially all of the residual hydrocarbon fraction of said second, minor gas fraction as a second liquid fraction. Cooling to a temperature of between about 105° K. and about 120° K., e.g., about 112° K., is suitable for this purpose. The partially condensed gas stream leaves heat exchanger 22 through line 13, essentially at the relatively high super-atmospheric pressure of the feed gas and is fed into gas-liquid separator 32. The second liquid fraction separated from the uncondensed, essentially hydrogen-containing second, minor gas fraction and is withdrawn from separator 32 through line 15. This liquid fraction is then throttled to a relatively low super-atmospheric pressure by passage through valve 51, thus developing refrigeration for cooling the acetylene-depleted, second gas fraction that passes from separator 40 in line 12.

The overhead uncondensed gas that passes from separator 32 through line 14 comprises hydrogen that is warmed sequentially in heat exchangers 22 and 20, against the cooling acetylene-depleted gas and the hydrocarbon feed gas mixture, respectively, prior to being recovered in said line 14 as hydrogen product gas. Similarly, the expanded second liquid fraction leaving valve 51 through line 16 is warmed sequentially in said heat exchangers 22 and 20. In particular embodiments, a small amount of product hydrogen is diverted through line 24 containing valve 52 for addition to the throttled second liquid fraction in line 16, thereby reducing the reboil temperature of the throttled liquid. The second liquid fraction warmed by passage through said heat exchangers is suitable for use, if desired, as a portion of the ethylene-enriched liquid to be recovered for further processing in the overall ethylene recovery plant.

The first, major gas fraction of uncondensed gas, removed in line 5 as indicated above, is further cooled in heat exchanger 21 at essentially the relatively high super-atmospheric pressure of the feed gas mixture to condense ethylene and most of the acetylene content thereof. Temperatures of from about 120° K. and about 140° K., e.g., about 125° K., are suitable for this purpose. Under such conditions, a third liquid fraction is thus formed without solidification of the condensed acetylene. The partially condensed first, major gas fraction leaves heat exchanger 21 in line 7 and passes into gas-liquid separator 31, wherein said third liquid fraction is separated from the uncondensed, first, major gas portion of the hydrocarbon feed gas mixture. This third liquid fraction, withdrawn from separator 31 through line 11, may comprise another feed stream for further ethylene recovery processing e,g., by treatment in a demethanizer column, not shown.

The uncondensed, first gas portion is withdrawn from separator 31 in line 8, and is warmed in heat exchanger 21 against the cooling first, major gas fraction in line 5 as described above. The warmed first, major uncondensed gas fraction is thereafter work expanded in turbine 50, thereby cooling said gas fraction and developing additional refrigeration for cooling gas fractions. Although not as effective as work expansion, refrigeration can also be developed by Joule-Thompson expansion. The thus-cooled and expanded first gas fraction is passed from turbine 50 through line 10 and is rewarmed sequentially in heat exchanger 21, where it provides additional cooling for the first, major gas uncondensed gas fraction in line 5, and in heat exchanger 20, where it provides cooling for the hydrocarbon feed gas mixture in line 1. Upon passing in line 10 from heat exchanger 20, the warmed, first gas fraction removed as a low pressure fuel gas.

The practice of the invention as described herein and illustrated in the drawing enables ethylene to be recovered in the first, and third liquid fractions, and hydrogen product gas to be recovered in line 14 without acetylene solidification problems in either the ethylene or the hydrogen recovery sections of the cold end of the ethylene recovery plant. This is a highly advantageous result, particularly as only the second, minor fraction of the uncondensed portion of the feed gas mixture is scrubbed for acetylene removal. By conducting the seperations at the ethylene recovery section at relatively high super-atmospheric pressure, it has been found possible generally to remove a sufficient quantity of ethylene in solution with said ethylene-containing third liquid fraction so that the subsequent work expansion of the uncondensed gas recovered in line 8 to lower pressure and temperature is not plagued with acetylene solidification problems.

In the practice of the invention, the hydrocarbon feed gas mixture is passed to heat exchanger 20 through line 1 at a relatively high super-atmospheric pressure of from about 25 to about 40 atmospheres (absolute), preferably at from about 30 to about 40 atmospheres. Upon separation of the first liquid fraction therefrom, it will be appreciated that the uncondensed gas, and the major and minor gas fractions thereof, will be at said relatively high super-atmospheric pressure. The second, minor gas fraction remains at said relatively high super-atmospheric pressure, but the second liquid fraction separated therefrom is throttled to a relatively low superatmospheric pressure below about 4 atmospheres (absolute). Acetylene solidification problems are effectively avoided at this stage of the process by the scrubbing of the acetylene content of said second, minor gas fraction prior to separation and throttling of the second liquid fraction.

The first, major gas fraction, which is not so scrubbed, remains at said relatively high super-atmospheric pressure as the third liquid fraction is separated therefrom. At such high pressures, it is found that most of the acetylene present in said first, major gas fraction is separated therefrom in said third gas fraction. The subsequent work expansion of the first, major gas fraction can thus be carried out to any desirable low pressure, as with the liquid throttled in value 51, without encountering acetylene solidification problems.

The invention can conveniently be practiced in an illustrative example in accordance with the description above, with the feed gas being introduced at a pressure of from 30 to 40 atmospheres (absolute), and being cooled to about 175° K. Upon separation of the first liquid fraction, the uncondensed gas portion is divided into a first, major portion comprising 90% of the molar flow rate of uncondensed gas in line 3. The second, minor portion comprising 10% of molar flow rate is scrubbed with ethylene in contactor 40 such that, at a flow rate of 100 lb. mole/hr of said second gas fraction containing about 0.09% vol. acetylene, the scrub liquid comprising 99.95% by weight ethylene at a flow rate of about 7.9 lb. moles/hr, the acetylene content of the gas leaving contactor 40 in line 12 is reduced to below about 100 ppm. The resulting acetylene-depleted gas is cooled in heat exchanger 22 to about 112° K., thereby condensing substantially all of the residual hydrocarbons in said second gas fraction. Upon separation of the second liquid fraction from said acetylene-depleted minor gas fraction, the second liquid fraction is throttled to a relatively low superatmospheric pressure of about 4 atmospheres (absolute). Because of the removal of acetylene in separator 40, however, no acetylene solidification problems are encountered because of the relatively low pressure to which the third liquid fraction is throttled.

The first, major gas fraction is maintained at the relatively high super-atmospheric pressure range of the feed gas. At such a pressure of 30–40 atmospheres (absolute), sufficient acetylene is removed from the first, major gas fraction in said third liquid fraction so that no acetylene solidification problems are encountered as the residual amount of said first, major gas fraction is work expanded to about 4 atmospheres (absolute).

Those skilled in the art will appreciate that various changes and modifications can be made in the details of the process herein described without departing from the scope of the invention as recited in the appended claims. It will also be appreciated that various preliminary steps may be employed, as for separation of carbon dioxide or sulfur compounds in accordance with the established practice of the art. It is also within the scope of the invention to employ all or any portion of the various liquid fractions, and/or the expanded first gas fraction, as feed to the demethanizer column of an overall ethylene recovery plant.

The invention thus provides for the advantageous separation and recovery of ethylene and hydrogen without the serious problem of acetylene solidification in either section of the process and without the necessity for treating all of the uncondensed gas for acetylene removal to avoid such an acetylene problem. By enabling only a minor portion of said uncondensed gas to be so treated, the invention effectively overcomes a known problem of major significance while desirably minimizing the capital and operating costs associated with the elimination of said problem.

Therefore, we claim:

1. An improved process for the separation and recovery of an ethylene-enriched liquid and hydrogen product gas from a hydrocarbon feed mixture containing said ethylene and hydrogen, together at least with acetylene and methane, comprising:

(a) cooling said hydrocarbon feed mixture, at a superatmospheric pressure of from about 25 to about 40 atmospheres (absolute), to condense a first liquid fraction containing ethylene and a major portion of the acetylene content of the feed mixture without solidification of said acetylene;

(b) separating said first liquid fraction from the uncondensed gas portion of said feed mixture, said uncondensed gas containing hydrogen and methane, together with the uncondensed portion of the ethylene and acetylene content of the feed mixture at said super atmospheric pressure, said first liquid fraction comprising ethylene-enriched liquid to be recovered;

(c) dividing said uncondensed gas into a first, major gas fraction and a second, minor gas fraction, said major fraction comprising at least about 75% of the molar flow of said uncondensed gas;

(d) scrubbing said second, minor gas fraction with an essentially acetylene-free liquid selected from the group consisting of ethylene, ethane, propylene, propane and mixtures thereof to remove a substantial portion of the acetylene content of said second gas fraction;

(e) cooling the thus acetylene-depleted second, minor gas fraction to condense residual hydrocarbons therefrom, thus forming a second liquid fraction;

(f) separating said second liquid fraction from the uncondensed, further cooled, essentially hydrogen-containing second, minor gas fraction at said relatively high, super-atmospheric pressure;

(g) warming said hydrogen-containing second, minor gas fraction, the warmed second gas fraction comprising hydrogen product gas;

(h) throttling said second liquid fraction to a relatively low super-atmospheric pressure, thereby cooling said liquid fraction and developing refrigeration for cooling said acetylene-depleted, second gas fraction in step (e);

(i) warming said throttled second liquid fraction by heat exchange with said cooling acetylene-depleted, second, minor gas fraction, (j) cooling said first, major gas fraction at said superatmospheric pressure of from about 25 to 40 atmospheres (absolute) to condense ethylene and most of the acetylene content therefrom, thus forming a third liquid fraction without solidification of the condensed acetylene;

(k) separating said third liquid fraction from the uncondensed, further cooled, first major gas fraction at said relatively high super-atmospheric pressure, said third liquid fraction being suitable for use as a portion of the ethylene-enriched liquid to be recovered;

(l) warming said first, major uncondensed gas fraction;

(m) expanding said warmed, first major gas fraction from relatively high to relatively low super-atmospheric pressure, thereby cooling said gas fraction and developing additional refrigeration for cooling gas fractions, whereby acetylene solidification is effectively avoided during ethylene and hydrogen separation and recovery without the necessity for treating a major portion of the uncondensed gas for removal of acetylene therefrom.

2. The process of claim 1 in which said acetylene-free liquid used to scrub the second, minor gas fraction comprises ethylene.

3. The process of claim 1 in which said first, minor gas fraction comprises at least about 85% of the molar flow rate of said uncondensed gas.

4. The process of claim 3 in which said major gas fraction comprises at least about 90% of the molar flow rate of said uncondensed gas.

5. The process of claim 3 in which said acetylene-free liquid used to scrub the second, minor gas fraction comprises ethylene.

6. The process of claim 1 in which said super-atmospheric pressure of the hydrocarbon feed mixture is from about 30 to about 40 atmospheres, (absolute).

7. The process of claim 5 in which said superatmospheric pressure of the hydrocarbon feed mixture is from about 30 to about 40 atmospheres (absolute).

8. The process of claim 1 and including passing a portion of said uncondensed, further cooled, essentially hydrogen-containing second, minor gas fraction into said second liquid fraction separated therefrom, said hydrogen serving to reduce the reboil temperature of said liquid.

9. The process of claim 1 in which said second, minor gas fraction is cooled to from about 105° K. and about 120° K. to condense said second liquid fraction, and in which said first, major gas fraction is cooled to from about 120° K. and about 140° K. to condense said third liquid fraction.

10. The process of claim 9 in which said second gas fraction is cooled to about 112° K.

11. The process of claim 10 in which said first gas fraction is cooled to about 125° K.

12. The process of claim 10 in which the hydrocarbon feed mixture is cooled to a temperature of from about 140° K. to about 185° K.

13. The process of claim 12 in which said acetylene-free liquid used to scrub said second, minor gas fraction comprises ethylene.

14. The process of claim 13 in which said first, minor gas fraction comprises at least about 85% of the molar flow rate of said uncondensed gas.

15. The process of claim 14 in which said superatmospheric pressure of the hydrocarbon feed mixture is from about 30 to about 40 atmospheres (absolute).

16. The process of claim 1 and including diverting a small portion of the hydrogen containing second, minor gas fraction to said throttled liquid fraction to reduce the reboil temperature thereof.

* * * * *